United States Patent [19]

Stahl

[11] 4,132,190

[45] Jan. 2, 1979

[54] APPARATUS FOR APPLYING NON-LIQUID MATERIAL TO BORE HOLES

[76] Inventor: Stanley E. Stahl, 1301 Rothermel Dr., New Berlinville, Pa. 19545

[21] Appl. No.: 702,887

[22] Filed: Jul. 6, 1976

[51] Int. Cl.[2] ..... B05C 7/00

[52] U.S. Cl. ..... 118/76

[58] Field of Search ..... 118/76, 225, 215, 214, 118/254, 105; 427/230; 69/29, 7.7; 8/12

[56] References Cited

U.S. PATENT DOCUMENTS

| | | | |
|---|---|---|---|
| 1,062,257 | 5/1913 | Schever | 118/254 |
| 1,312,420 | 8/1919 | Narber | 118/76 |
| 1,423,052 | 7/1922 | Van Guelpen | 69/7.7 |
| 1,671,374 | 5/1928 | Moore et al. | 118/215 X |
| 2,432,401 | 12/1947 | Etem | 118/215 |
| 3,904,718 | 9/1975 | Kuehn, Jr. | 118/254 X |
| 3,990,389 | 11/1976 | Edinger et al. | 118/76 |

FOREIGN PATENT DOCUMENTS

| | | | |
|---|---|---|---|
| 536602 | 1/1957 | Canada | 427/230 |

*Primary Examiner*—Werner H. Schroeder
*Assistant Examiner*—Andrew M. Falik

[57] ABSTRACT

This invention relates to apparatus for applying color to the bore of perforations in various materials and more particularly to a device for coloring the buckle holes in belts usually made of leather or similar material. More particularly the device comprises a driven spindle rotatably mounted in a base having one or more recesses or grooves for holding a coloring wax which is applied to the bore of an object such as a strip of leather to which the coloring material is applied so that the bore of the hole, which may be in a belt, has the same appearance as the dye applied to the exterior of the belt. A variety of wax indentations is described as well as the use of a multiple spindle device.

3 Claims, 17 Drawing Figures

Figure 2:
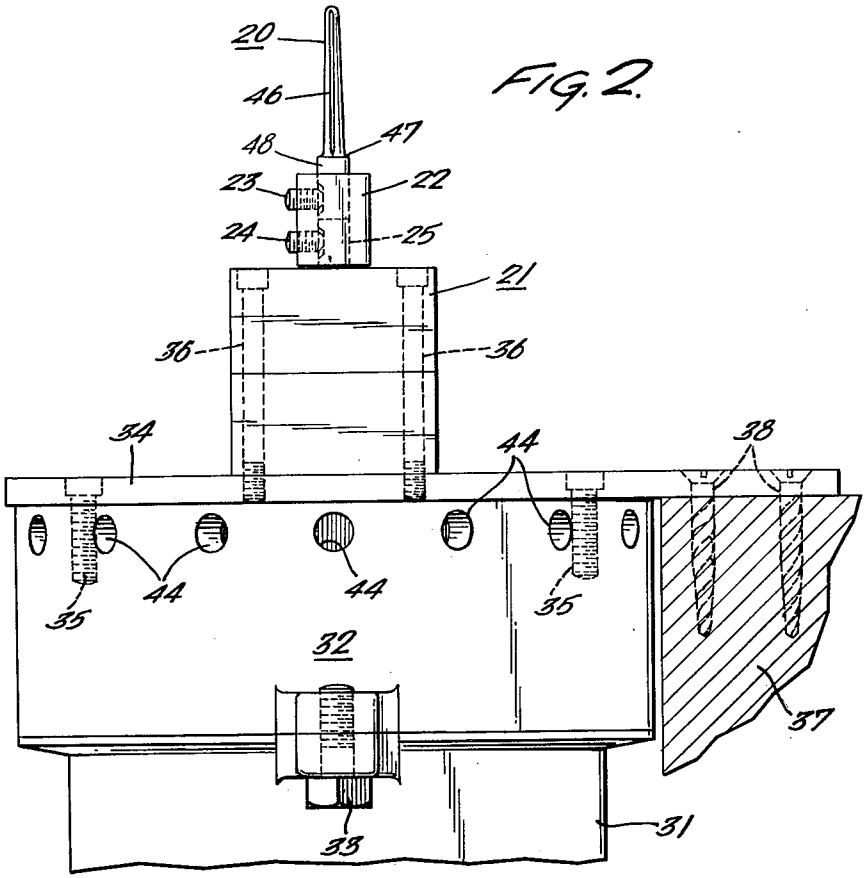

38
37
35
44
34
32
36
21
28
20
22
33
42

20
46
47
48
56
23
53
58
57
55
51
54
52
62

16.
17.
20
56
53
54
51
52
62
61
59
60
M 20
53
54
51

APPARATUS FOR APPLYING NON-LIQUID MATERIAL TO BORE HOLES

BACKGROUND OF THE INVENTION

In the manufacture of leather belts for apparel which are customarily produced in varying colors, it has herefore been impossible to apply the same coloring to the bore of the buckle holes in the belt to match the color of the belt itself. These belts are dyed prior to the punching of the holes for various reasons, but particularly in view of the fact that the holes must be located in the belt in accordance with the predetermined length of the belt as may be required to fit the size of the wearer. The raw leather appearing in the unused holes is considered to be highly undesirable and unsightly.

Many attempts have been made to apply a liquid dye to the bores of the punched holes and this has met with no success because the dye cannot be confined to the bore and it therefore creates an unsightly appearance around the outside of the belt area adjacent to the holes. Furthermore in the mass production of such belts this is a manual operation requiring several skilled operators and therefore not only impractical but quite expensive. Various types of machine operated wicking devices have been designed to eliminate the manual operation, but still with no success.

OBJECTS OF THE INVENTION

It is therefore the primary object of the present invention to apply coloring material or dye to the bores of buckle holes in belts, shoes and similar objects in a non-liquid form such as a coloring wax.

A further object of the invention is to provide an apparatus in which a non-liquid wax dye can be simultaneously applied to a plurality of buckle holes in a belt. Further objects will be apparent from the specification and drawings.

Figure 4:
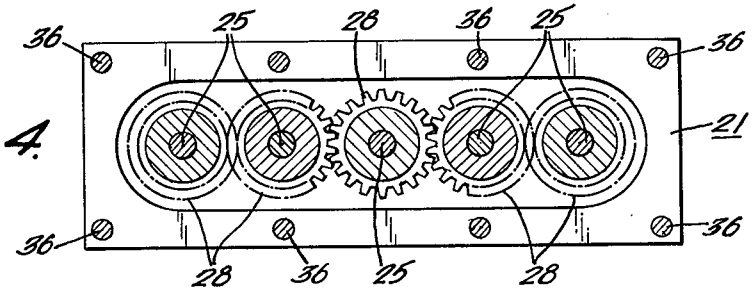
Figure 1:
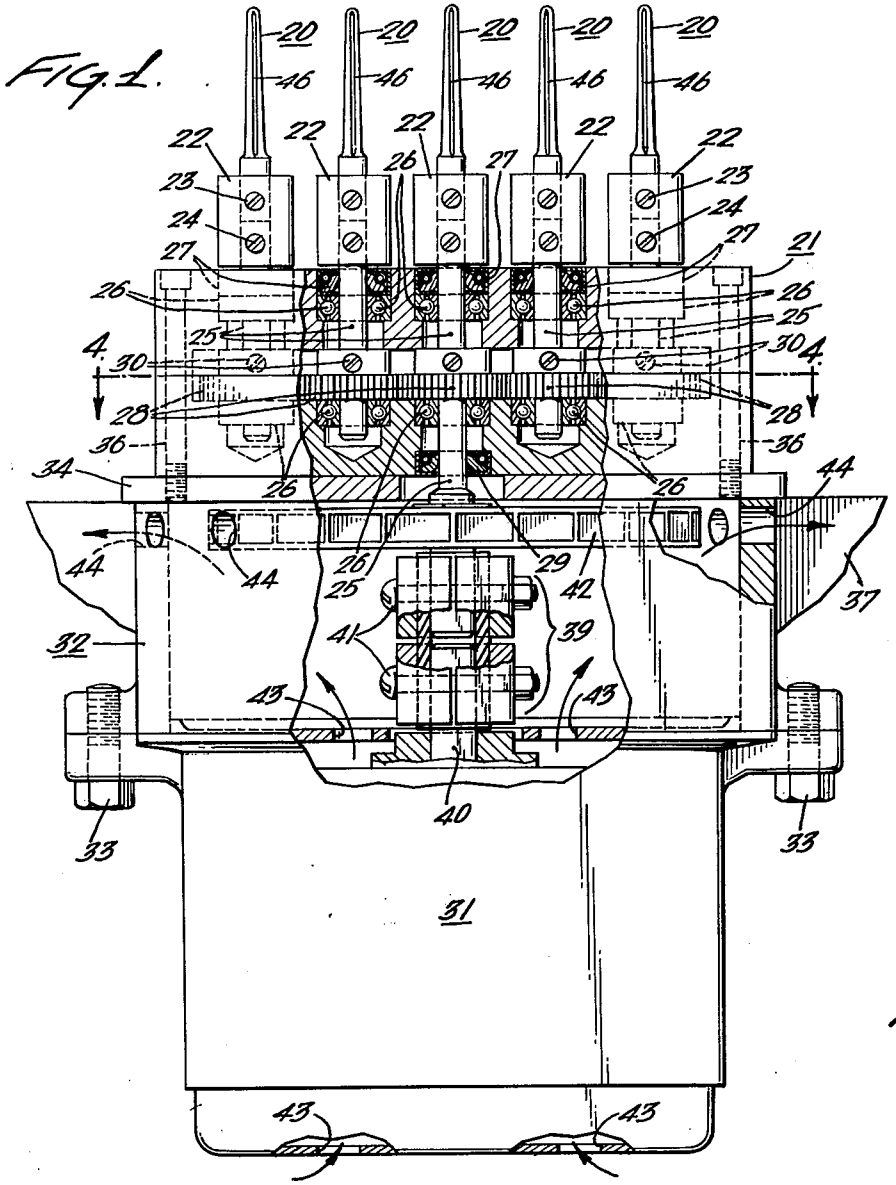
Figure 3:
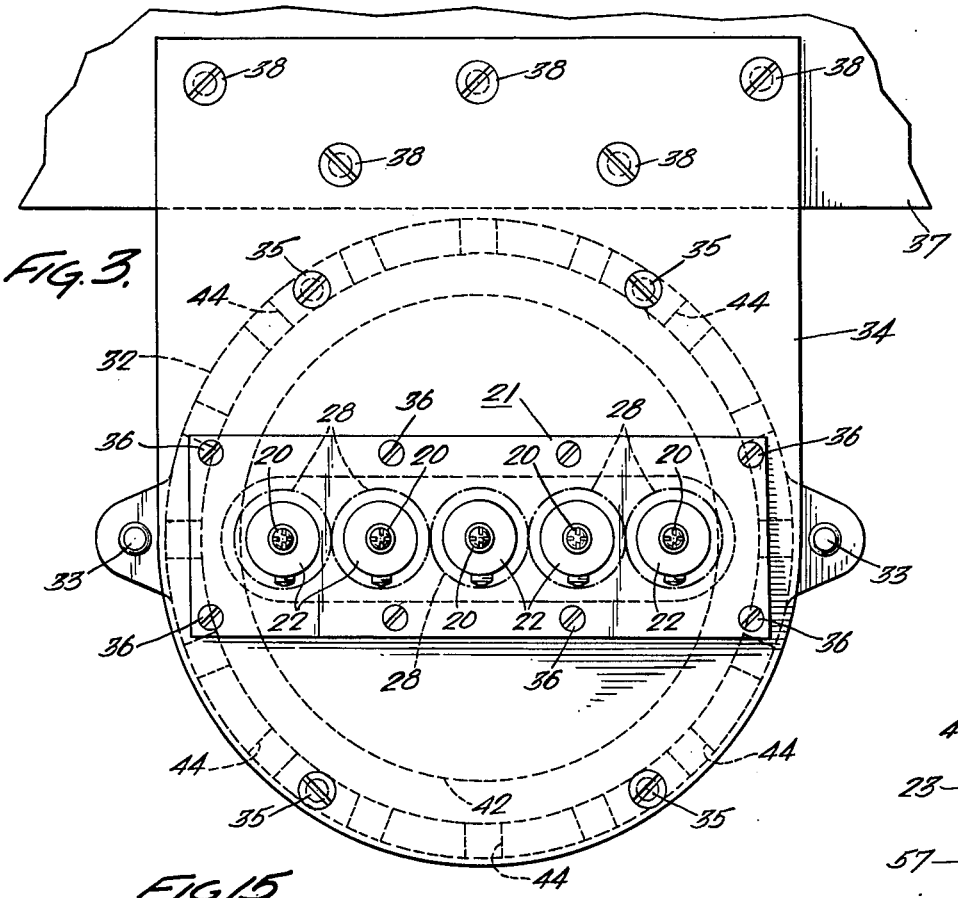
Figure 17:
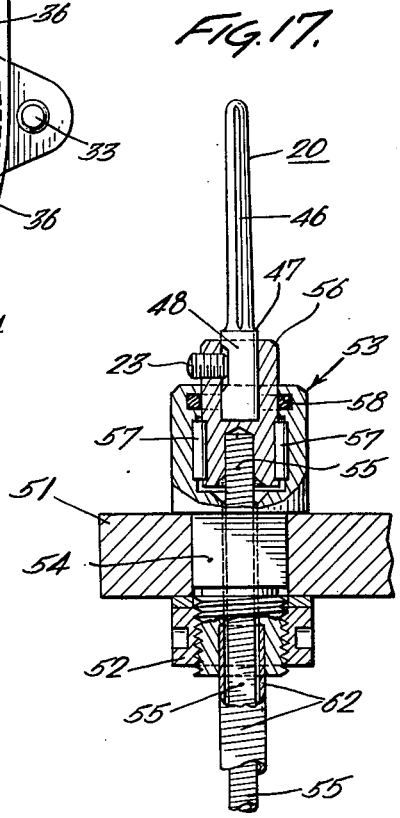
Figure 15:
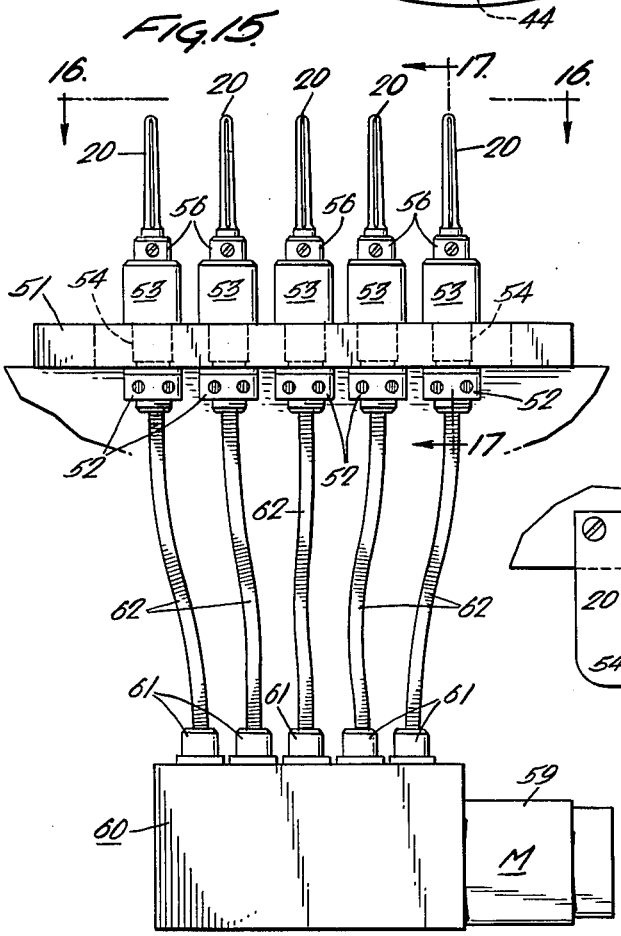
Figure 16:
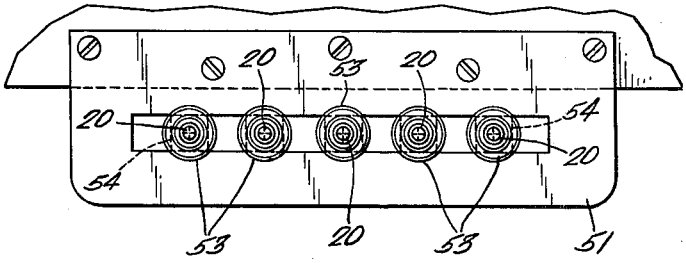
Figure 5:
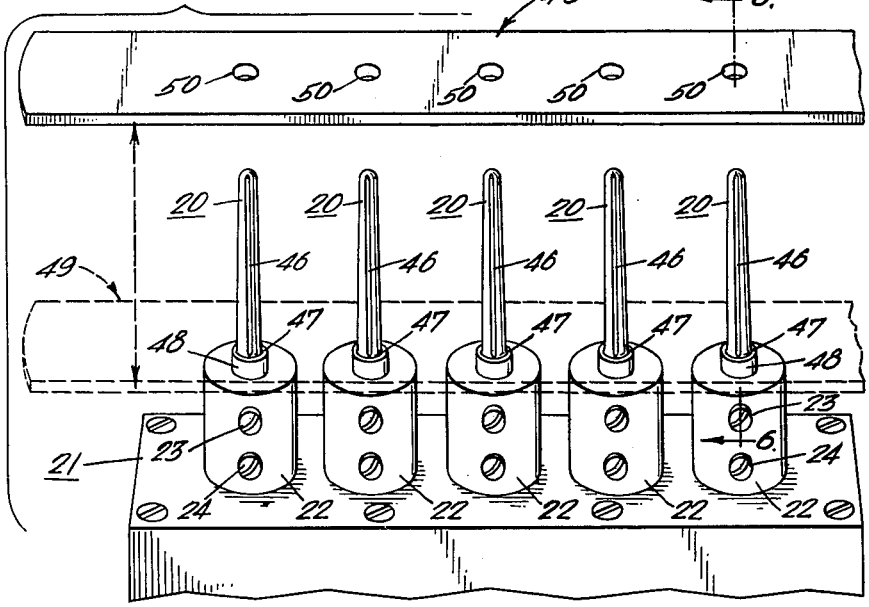
Figure 6:
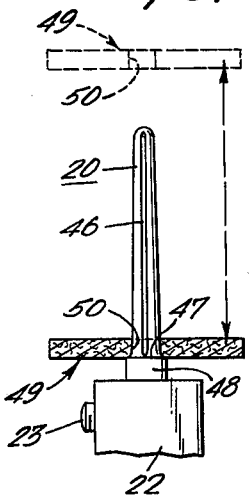
Figure 7:
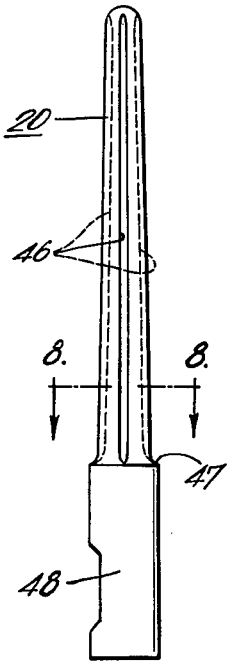
Figure 9:
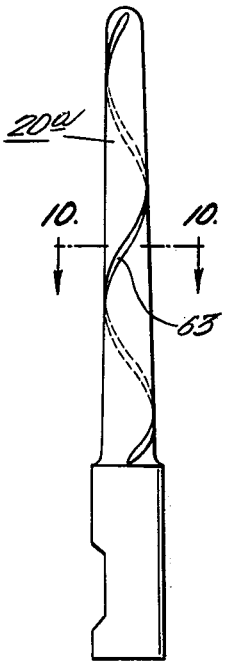
Figure 11:
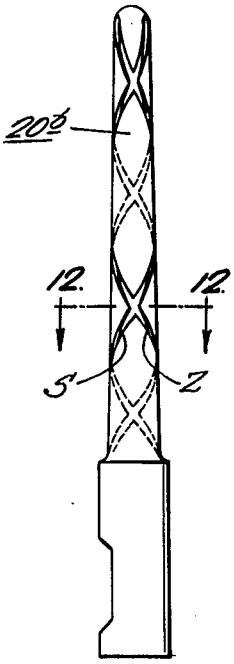
Figure 13:
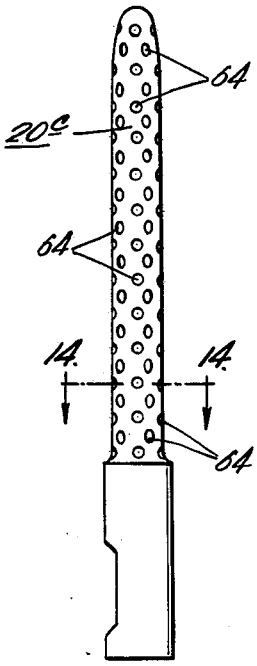
Figure 8:
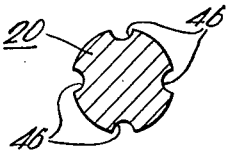
Figure 10:
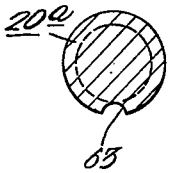
Figure 12:
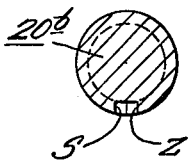
Figure 14:
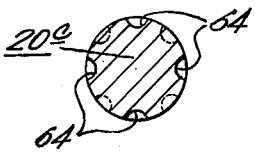

IN THE DRAWINGS,

FIG. 1 is a side view partially sectioned, of a five spindle device embodying the present invention, FIG. 2 is an end view of the structure of FIG. 1, FIG. 3 is a top view of the structure of FIG. 1, FIG. 4 is a section as seen at 4—4 of FIG. 1, FIG. 5 is a perspective showing the method of simultaneously applying a wax dye to the bores of a belt or the like, FIG. 6 is a sectional detail as seen at 6—6 of FIG. 5, FIG. 7 is an enlarged view of the preferred form of spindle used in the apparatus of FIGS. 1-6, FIG. 8 is a section as seen at 8—8 of FIG. 7, FIGS. 9, 11 and 13 show modifications in the spindles incorporating various types of grooves and recesses for retaining and applying the wax dye, FIGS. 10, 12 and 14 are sections as seen at 10—10, 12—12 and 14—14 of FIGS. 9, 11 and 13 respectively, FIG. 15 shows a modified form of the apparatus of FIG. 1 in which the spindles are independently driven and can be relatively adjusted to accomodate various spacings in the holes, FIG. 16 is a top view as seen at 16—16 of FIG. 15, and FIG. 17 is an enlarged sectional detail as seen at 17—17 of FIG. 15.

The present apparatus involves the application of a wax coloring material to the bore of an aperture by means of a bank of tapered and grooved spindles 20,20 journaled in a housing 21 (FIG. 1). Each spindle 20 is removably mounted in a collar 22 by means of a set screw 23 as seen in FIG. 2. Each collar 22 is in turn secured by a set screw 24 to vertical shafts 25,25 which are journaled in bearings 26,26 provided with oil seals 27,27 in housing 21. Shafts 25,25 for each spindle are driven by intermeshing gears 28,28. The middle shaft 25 is elongated to extend downwardly through housing 21 and is provided with an oil seal 29. Set screws 30,30 retain the gears in position on shafts 25,25. A motor 31 is suspended from fan chamber 32 by cap screws 33,33. Chamber 29 is mounted under and to plate 34 by recessed cap screws 35,35 and housing 21 is held on top of plate 34 by recessed cap screws 36,36. The entire assembly above is conveniently mounted on a work table or bench 37 by screws 38,38. The driving connections from motor 31 to the elongated shaft 25 comprise a flexible coupling 39 fastened to the end of driving shaft 25 and to the motor shaft 40 by bolts 41,41 (FIG. 1). Elongated driving shaft 25 also carries a fan 42 to provide adequate ventilation for motor 31 through air inlet ports 43,43,43,43 and a series of exhaust ports 44,44.

Referring now to FIG. 7, each spindle is provided with at least one groove 46 or similar indentation for receiving and applying the coloring wax. In the preferred form of FIG. 7, the spindle 20 has four axial grooves 46,46 extending from the tip of the spindle to a larger diameter shoulder area 47 near the shank 48 of the spindle. In the preferred form, the grooved area of spindle 20 has a one degree taper (two degrees included) from top to bottom, and it will be understood that the diameter of the spindle either at the top or the bottom will be made in accordance with the diameter of the holes to be dyed. Various size spindles can be used to color either larger or smaller holes, however, the tip of the spindle should be sufficiently small to permit ready insertion into the hole.

In operation, the motor 31 is started which in turn causes the five spindles 20,20 to rotate respectively in opposite directions. A cake of coloring wax or similar material of the type available on the market under the trade name "Yankee Polish Color Wax" supplied by Luth and Company of Hamburg, Germany, has been found to be highly satisfactory. This cake of wax is lightly held against the five spindles simultaneously or individually, thereby filling all the grooves 20 with the wax. A belt or similar object 49 is then held over the set of spindles as shown in FIG. 5 and the operator then depresses the belt over the spindles thus applying the coloring material to the bores of the buckle holes 50,50 in the belt. This operation requires only a matter of seconds and eliminates the undesirable raw color appearance of the buckle holes. The dye coloring of course will ordinarily match the color of the belt. Shoulders 47,47 on each of the spindles serve as limit stops for the downward movement of the belt thereby avoiding excessive enlargment of the buckle holes and also providing equal vertical travel for the belt on each spindle, FIG. 6.

The application of a non-liquid dye to the buckle holes has been found to eliminate waste of material and the unsightly application of the dye to the surface of the belt. It is much easier to control the amount of dye applied, thereby avoiding waste material. When the cake of wax decreases below a conveniently useable size, any excess can be recovered and remelted into a new cake.

Referring now to FIGS. 15–16, a modified form of the invention which provides lateral adjustment for the spindles to accomodate hole spacings which are not uniform or which may be uniformly larger or smaller than normal is shown. In this form the spindles 20,20 mounted in their collars 22,22 are retained in a slotted plate 51, (FIG. 16) and secured therein by means of internally threaded collars 52,52 (FIG. 17) which clamp each sleeve 53 against plate 51 and are held by square shanks 54,54. In this form each driveshaft 55,55 is threaded into a collar 56,56 journaled in the upper portion of the sleeves 53,53 by needle bearings 57,57 having an oil seal 58, and as in the form of FIG. 1 the spindles 20,20 are retained in collars 56,56 by set screws 23,23. The spindles are driven from motor 59 through a gear box 60 which may be comparable to housing 21 but provided with fixed couplings 61,61 flexible shafts 62,62, keyed to the ends of driveshafts 55,55. This construction permits relative lateral spacing between each pair of fixed but adjustable sleeves 53,53. This feature is not achievable in the construction of FIG. 1.

During the course of considerable testing it has been found that the axially straight grooves 46 shown in FIG. 7, for each spindle are the preferred form since they provide adequate application of the wax and are the least expensive to manufacture. This form is adapted for belts having holes approximately three-sixteenths inch in diameter. The tip of each spindle has a diameter of 0.170 inch and a base diameter of 0.214 inch. For holes approxmiately one-sixteenth inch diameter, a spindle having a tip diameter of 0.130 inches and a base diameter of 0.180 inch may be used. It has been found that the optimum dimensions for each groove are 0.010 inch deep and 0.025 inch wide. Also as noted above it has been found that four grooves on each spindle are preferred since this permits holding sufficient dye wax to reduce the required time to refill the spindles. It will be understood of course that the spindle size may be altered to accomodate the size of hole in which it is to be inserted. The taper on the spindle is desirable in order to facilitate insertion in each of the holes and to insure full application of the dye over the entire bore hole.

FIGS. 9, 11 and 13 show modifications of spindles which incorporate variations in the type of wax applying recess on the spindles. They may be utilized where special circumstances would indicate their desirability over the axially straight grooves of FIG. 17. In FIG. 9 the spindle 20a is provided with a single spiral groove 63 having an S twist. In utilizing the spiral groove of FIG. 9 in the apparatus of FIG. 1, it has been found that the spiral grooves on spindles rotating in one direction have a tendency to pull the belt down on the spindle whereas the opposite is the case on those spindles turning in the other direction. It will be understood of course that since spindles in the structure of FIG. 1 are interconnected by means of the spur gears, the two outermost spindles rotate in the same direction as the center spindle. The spindles directly engaged with the center spindle each turn in the opposite direction from it. In a situation in which it is desired to use a spirally grooved spindle, this disadvantage can be overcome by using spindles with the S twist for the center spindle and the two outer spindles but with a Z twist in the intermediate spindles. Another means of avoiding this difficulty is to use the spindle **20*b* shown in FIG. 11**, which combines the S and Z spirals on the same spindle.

Another modification is shown in FIG. 13 which is cylindrical rather than tapered. In this form spindle 20c is provided with a series of indentations 64 for retaining the dye wax. It will be evident that the indentations as opposed to a spiral or straight groove can also be used on a tapered spindle.

It will therefore be understood that the present invention represents the culmination of much effort to apply, at a minimum of expense and without any undesirable results, coloring material to the bore of any article such as shoes, belting, or other items in which it is important from the standpoint of appearance to eliminate the raw cut appearance of the apertures. For example, even in a situation where a larger or irregular aperture is desired to be colored, it would be possible to employ a single spindle in which event the operator would simply wipe the material against the spindle around the periphery of the aperture. This coloring could not be done successfully using a liquid dye for the reasons stated above and the apparatus described herein not only enables the application of a non-liquid dye to permit extremely fast production of belts having fixed holes which can be simultaneously dyed with one stroke of each operator.

Having thus described my invention, I claim

1. Apparatus for applying a non-liquid coloring material to the bore of a hole therein which comprises a plurality of spindles rotatably mounted in a support, at least one non-circumferential recess on each of said spindles for receiving the non-liquid material, means for injecting the spindles to the full depth of their associated bores, the support for the spindles being slotted to provide relative adjustable spacing for the spindles, a motor for driving these spindles, and a plurality of flexible connections between the motor and each of the spindles.

2. Apparatus in accordance with claim 1 in which the spindle has at least one spiral groove.

3. Apparatus in accordance with claim 1 in which the spindle is provided with a plurality of axial grooves.

* * * * *